US006827222B1

(12) United States Patent
Nilsson

(10) Patent No.: US 6,827,222 B1
(45) Date of Patent: Dec. 7, 2004

(54) GRAVEL SORTER

(75) Inventor: Nils Lennart Nilsson, Jokkmokk (SE)

(73) Assignee: Nimek Industries NYA Aktiebolag (SE)

( * ) Notice: Subject to any disclaimer, the term of this patent is extended or adjusted under 35 U.S.C. 154(b) by 336 days.

(21) Appl. No.: 10/069,239

(22) PCT Filed: Aug. 24, 2000

(86) PCT No.: PCT/SE00/01633

§ 371 (c)(1),
(2), (4) Date: Feb. 22, 2002

(87) PCT Pub. No.: WO01/14643

PCT Pub. Date: Mar. 1, 2001

(30) Foreign Application Priority Data

Aug. 24, 1999 (SE) ..... 9902985

(51) Int. Cl.[7] ..... B07B 1/18; B07B 1/49

(52) U.S. Cl. ..... 209/284; 209/288; 209/293; 209/420; 209/421

(58) Field of Search ..... 209/931, 235, 209/236, 240, 261, 262, 263, 264, 265, 270, 284, 285, 288, 293, 296

(56) References Cited

U.S. PATENT DOCUMENTS 4,872,977 A * 10/1989 Jackson ..... 210/173
5,108,584 A * 4/1992 Brosseuk ..... 209/44

FOREIGN PATENT DOCUMENTS

AU 41762/85 10/1985
FR 2651812 A1 * 3/1991 ..... E01H/12/00
GB 2188567 10/1987
SE 451207 9/1987

OTHER PUBLICATIONS

International Search Report (PCT/ISA/210) of International Application No. PCT/SE00/01633.

* cited by examiner

*Primary Examiner*—Donald P. Walsh
*Assistant Examiner*—Jonathan R Muller
(74) *Attorney, Agent, or Firm*—Smith, Gambrell & Russell, LLP

(57) ABSTRACT

A mobile gravel sorter, which is arranged to move in a direction of travel along a road, comprising a gathering unit which is arranged to gather up granular material from a roadway as the gravel sorter moves in the direction of travel, a sorting unit (30) for sorting and supplying to the roadway the amount of the material that is smaller than a given grain size, and a collecting unit for collecting material exceeding said given grain size. The sorting unit (30) comprises a substantially circular drum which is arranged after the gathering unit in the direction of travel and which has a center axis (32), an inlet means in connection with the gathering unit and an outlet means which is arranged in connection with the collecting unit and separated from the inlet means in the longitudinal diction of the drum, at least one scerw conveyor (34, 35) which extends in the drum between the inlet means and the outlet means about a helical axis which is substantially concentric with the center axis (32) of the drum, and a screen cloth means (37) which is arranged to cover openings in the circumferential surface of the drum.

11 Claims, 3 Drawing Sheets

GRAVEL SORTER

TECHNICAL FIELD

The present invention relates to a mobile gravel sorter, which is arranged to move in a direction of travel along a road, comprising a gathering unit which is arranged to gather up granular material from a roadway as the gravel sorter moves in the direction of travel, a sorting unit for sorting and supplying to the roadway the amount of the material that is smaller than a given grain size, which sorting unit comprises a substantially circular drum which is arranged after the gathering unit in the direction of travel and which has a centre axis, an inlet means in connection with the gathering unit and an outlet means which is arranged in connection with the collecting unit and separated from the inlet means in the longitudinal direction of the drum, a collecting unit for collecting material exceeding said given grain size, and a screen cloth means which is arranged to cover openings in the circumferential surface of the drum.

TECHNICAL BACKGROUND

As described in the brochure "road maintenance bare ground" issued by the National Swedish Road Administration, the wearing course of a gravel road is worn and ground down under the action of traffic and grading. The coarse material is crushed to a sandy material. The fine material dusts away and some of the gravel material is thrown out on the embankment. The wearing course is transformed into gravel which is sensitive to corrugation and has an excess sand fraction. After some time, the gravel road has such poor standards as concerns the composition and thickness of the wearing course and a reduced runoff of surface water that it is necessary to take measures to improve the wearing course and the water runoff.

A well-balanced cycle of measures to maintain acceptable runoff of surface water and a correct composition of the wearing course is important to obtain the lowest possible total cost of gravel road maintenance.

Today, there are about 284,000 km private roads in Sweden which are covered with a new layer of gravel year after year. This results in high costs and has a considerable impact on the environment, since gravel is getting scarce. The gravel that has been spread out on the roads has not disappeared, but most of it has been pressed out into the ditches.

According to prior-art methods and by using prior-art road machines, the maintenance is carried out by adding gravel and stone material having a fraction of 4–18 mm, which is the ideal size of the gravel and stone material in order to obtain a satisfactory bearing capacity, and possibly by cutting the edges of the roadway and drawing up the thrown-out material. The material that has slid down the embankment has a relatively high share of material with a size in the upper range of said fraction and therefore it is of great interest to recover this material.

The drawn-up material sometimes comprises a high amount of turfs and contains relatively large stones, and herefore it cannot be used directly since such a composition of material on the road would result in a road with too poor a bearing capacity.

In the brochure "road maintenance bare ground", two different ways of treating the drawn-up material are described.

According to the first alternative, the line of drawn-up material is loaded into the vibrating grate bucket of a wheel loader, by means of which too large stones and turfs are sorted out. After sorting, the remaining material is emptied onto the surrounding ground, where possible. This method requires a road grader, which cuts the edges of the road and draws back the material, and a wheel loader with a vibrating grate bucket, which means that two drivers are needed.

According to the second alternative, use is made of a so-called stone picker (schematic view, see FIG. 6). The stone picker is attached directly to the road grader or pulled by a separate tractor running after the road grader. Such a stone picker, which is designed to pick up stones in a field, has a number of arms rotating about a shaft which is arranged parallel to the surface of the ground and transversely of the longitudinal direction of the road. The arms encounter stones and turfs in the line of drawn-up material and throw them into a container. When the turfs are thrown into the container, a great amount of gravel is entrained.

According to the first alternative, a succession of machines and thus a number of drivers are required. According to the second alternative, too large quantities of gravel disappear.

SE-451,207 discloses a sorting machine for immediately reusing road gravel in material originating from road maintenance, such as material from graded road sides and edges. The sorting machine has a collecting assembly which collects the material, a conveyor belt which conveys the material from the collecting assembly up to a tumbler which is horizontally arranged and which separates the road gravel and puts it down on the roadway. The sorting unit further has a second conveyor belt which conveys undesired stones and the like from the collected material up to a container. The sorting unit is provided with a motor and is self-propelled. Also this construction requires two operators, one driving the road grader and another driving the sorting unit.

Both the stone picker and the sorting unit are insufficient in case irregular quantities of material have been graded off along the road. They are not capable of levelling the quantities along the road, and the separated roadway gravel will also be spread out irregularly.

SUMMARY OF THE INVENTION

One object of the present invention is to provide a solution of the above-mentioned problems.

Another object is to provide a solution which requires as few persons (drivers) as possible and which minimises the need to add new gravel.

These objects are achieved by means of a mobile gravel sorter, which is of the kind stated by way of introduction and which is characterised in that the sorting unit comprises a substantially circular drum which is arranged after the gathering unit in the direction of travel and which has a centre axis, an inlet means in connection with the gathering unit and an outlet means which is arranged in connection with the collecting unit and separated from the inlet means in the longitudinal direction of the drum, at least one screw conveyor which extends in the drum between the inlet means and the outlet means about a helical axis which is substantially concentric with the centre axis of the drum, and a screen cloth means which is arranged to cover openings in the circumferential surface of the drum.

Preferred embodiments of the invention are stated in the dependent claims.

In the radial direction, the screw conveyor advantageously has an extension that is smaller than the inner radius of the drum and extends from the inside of the circumferential surface of the drum so that an axially directed return chamber forms about the centre axis between the inlet and the outlet means of the drum. As a result, it will be possible, when a great amount of material is fed into the gravel sorter, for the amount of the material that exceeds the volume of the defined space to be returned to preceding helical turns, and therefore there is time for all the material to be processed and passed through the meshes of the screen cloth.

Preferably, the drum and the screw conveyor are arranged to rotate together as one unit. Consequently, the problem of material getting stuck between two elements that are movable in relation to each other is avoided, which prevents the sorting unit of the gravel sorter from jamming.

BRIEF DESCRIPTION OF THE DRAWINGS

Below, the invention will be described in more detail with reference to the accompanying schematic drawings, which for the purpose of exemplification show a presently preferred embodiment of the invention.

DESCRIPTION OF A PREFERRED EMBODIMENT

Figure 1:
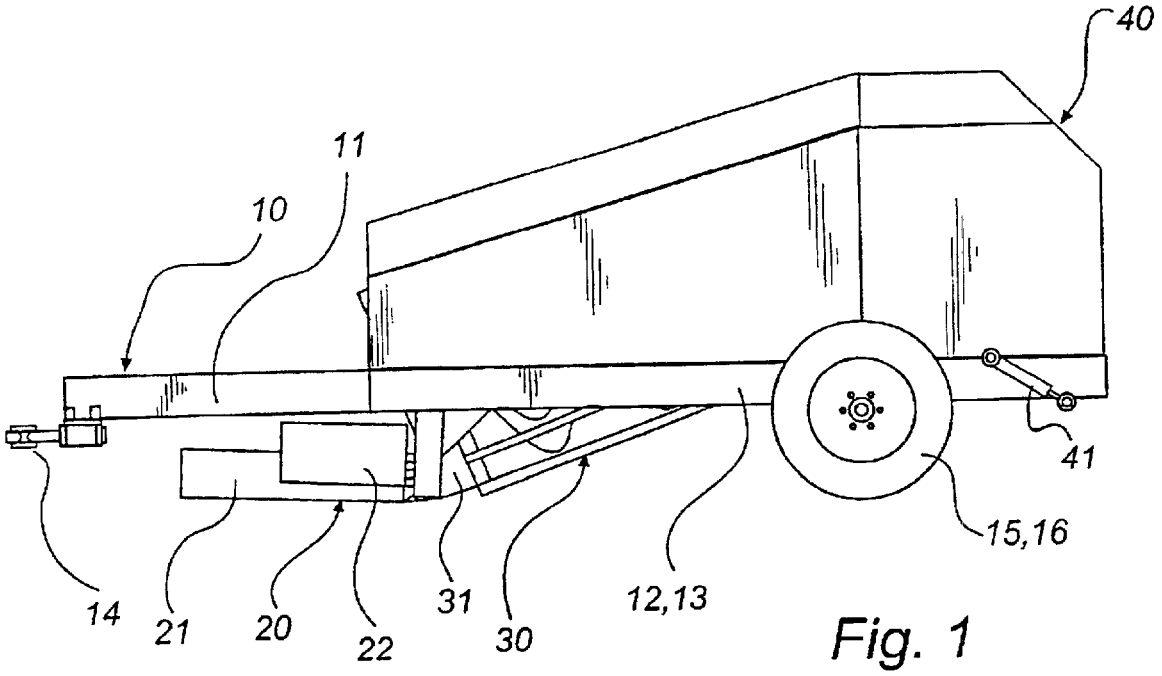
FIG. 1 is a side view of the mobile gravel sorter.
Figure 2:
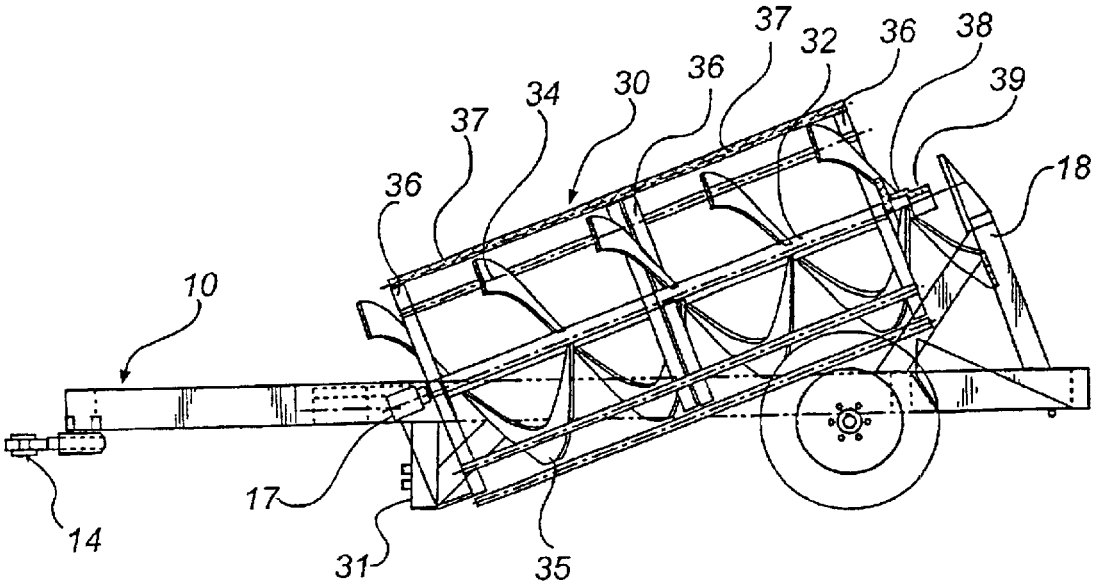
FIG. 2 shows the mobile gravel sorter with removed cover from the side.

The main components of the gravel sorter comprise a chassis 10, a gathering unit 20, a sorting unit 30 and a collecting unit 40 (see FIGS. 1 and 2).

The chassis 10 consists of a Y-shaped frame structure 11–13 and is arranged to be connected to a road grader, tractor, wheel loader or the like, via a coupling 14 at the end of the leg 11, which is the single part of the Y and arranged in the front part of the chassis. Two wheels 15, 16 are mounted on the two spaced-apart legs 12, 13 of the Y arranged in the rear part of the chassis, thus making the gravel sorter roll along the road that is to be worked.

The gathering unit 20 is composed of sections 21, 22 which are arranged to gather the material in the line of drawn-up material and convey this material to the inlet opening 31 of the sorting unit 30.

Figure 4:
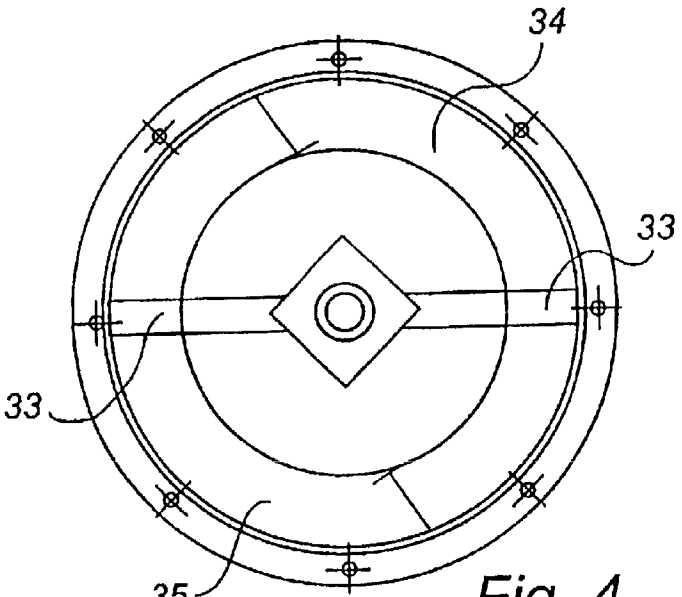
FIG. 4 shows the drum and the screw conveyor of the mobile gravel sorter seen from the inlet along their centre axes.
Figure 5:
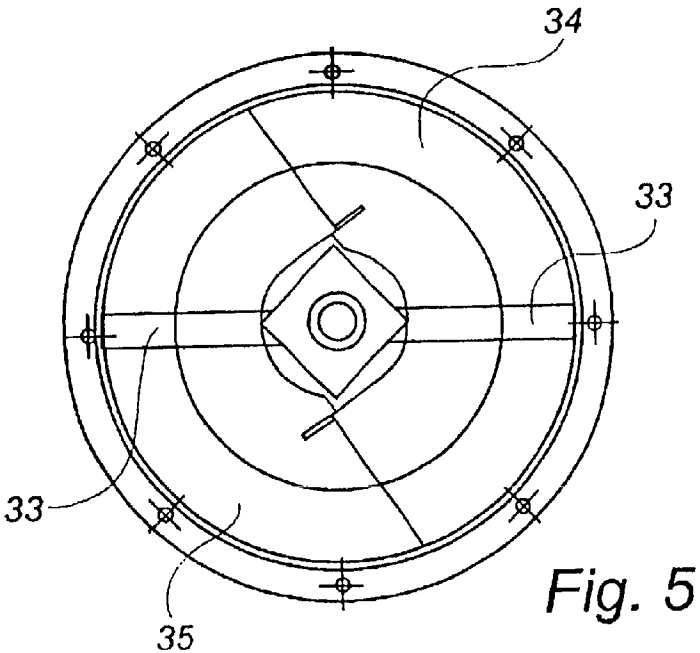
FIG. 5 shows the drum and the screw conveyor of the mobile gravel sorter in cross-section in a view similar to that in FIG. 4 at a distance from the inlet.
Figure 6:
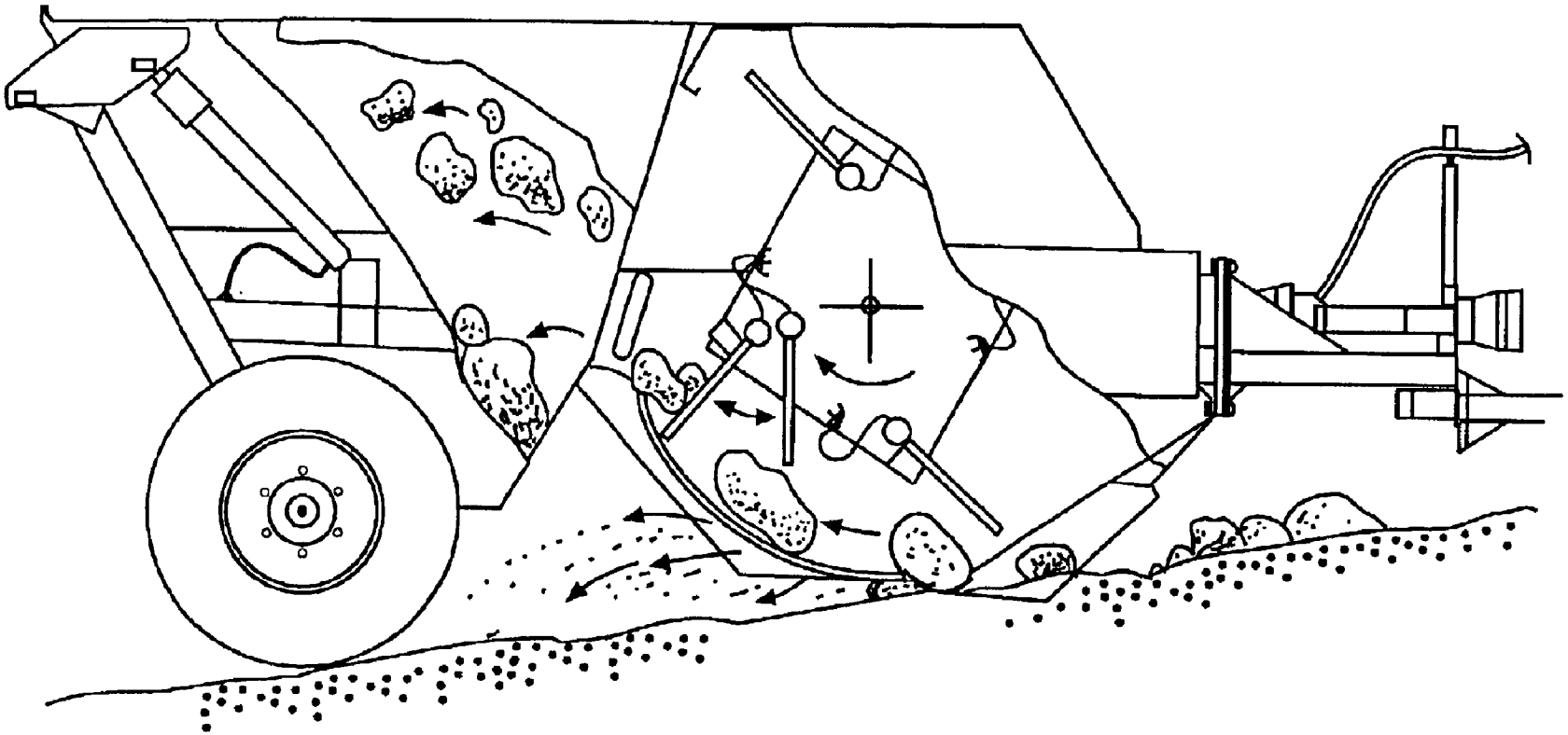
Fig. 6 (Prior Art)
FIG. 6 shows a stone picker according to prior-art technique.

The sorting unit 30 is secured to its centre shaft 32 and rotates therewith (see FIGS. 2, 4 and 5). On this centre shaft 32, two struts 33 are mounted opposite to each other in the radial direction at three places, namely at the two ends and in the middle. The struts 33 in turn support two flanges 34, 35 which in a helical line each, in the radial direction at a distance from the centre shaft 32, extend along the centre shaft 32. The struts 33 project a short distance from the helically shaped flanges 34, 35 and support a ring 36 (one at each end and one in the middle of the longitudinal direction of the centre shaft). These rings 36 form three circular outlines of a cylinder, and on these rings 36 a self-supporting screen cloth 37 is secured so that they are interconnected and so as to form a cylindrical drum. The screen cloth 37 is made of woven 5 mm spring steel and the size of its meshes is approximately 10% greater than the desired maximum size. The thus formed sorting unit 30 has a shape which is similar to that of a nut having two thread starts. The struts 33 project a short distance from the flanges 34, 35, which results in a gap being formed between the outer material (the screen cloth 37) and the threads (the flanges 34, 35) which gap is bridged by the struts 33.

The sorting unit 30 is suspended from the chassis 10 so that the projection of its centre shaft 32 on the roadway is parallel to the direction of travel, with an inclination of about 20° in relation to the horizontal plane so that its front end is located below its rear end. The front end of the centre shaft 32 is arranged to fit into a seat 17 placed in the chassis 10 approximately where the single leg of the Y merges with the other two legs. At the other end, the centre shaft 32 is supported by the chassis 10 by means of an upright frame structure 18.

At the rear end of the centre shaft 32, a planetary gear 38 is arranged having a hydraulic motor 39 mounted directly thereon. The planetary gear 38 and the motor 39 are dimensioned to function as a support for supporting the sorting unit 30. This results in a simple and robust system which only requires a simple recess in the frame structure 18 of the chassis 10, in which recess the motor 39 and the planetary gear 38 are placed, after which the motor 39 is non-rotatingly secured by means of bolts.

The oil pressure of the hydraulic motor 39 is supplied via a quick coupling connected to the hydraulic system of the traction vehicle and lines arranged in the chassis 10.

In the radial direction, the helical flanges 34, 35 have an extension which is smaller than the distance between the centre shaft 32 and the screen cloth 37 and are arranged adjacent to the screen cloth 37 (with a small gap), which results in an open space being formed in the middle of the drum about the centre shaft 32 (see FIG. 5). However, precisely at the start of their helical shape, the flanges 34, 35 have an extension in the radial direction that is only slightly smaller than the radial distance between the centre shaft 32 and the screen cloth 37. This design has been found to be advantageous for the feeding and retaining of material.

At the rear end of the chassis 10 of the gravel sorter, a collecting unit 40 is arranged. This collecting unit 40 receives the material which has not passed through the meshes of the screen cloth 37 during the time and along the distance that the material has been worked and conveyed through the sorting unit 30. The collected material, for instance, large stones, grass roots and parts of plants, constitutes material that is not desirable in the base of the road, since it has a negative effect on the bearing capacity of the base or the wearing course.

The mobile gravel sorter described above is above all intended to be used in the maintenance of existing gravel roads, where the aim is to recover the gravel which has slid down the embankment due to road traffic and the action of the weather. The material that has slid down the embankment is drawn up by means of a scraper or grader mounted on a tractor or road grader and gathered in a line on the road. The traction vehicle of the gravel sorter passes over the line of material which is gathered by the gathering unit 20 of the gravel sorter and further conveyed into the sorting unit 30. In the rotating sorting unit 30, the material is further conveyed upwards by means of the helical movement of the flanges 34, 35. Stones and gravel having a size that is smaller than a given size falls through the meshes of the screen cloth 37 down on the road. During the time when the material passes through the sorting unit 30, all turfs are broken up, the gravel bound thereto being released and falling down on the road. Large stones and plant parts do not fall through the screen cloth 37 and are further conveyed to the collecting unit 40.

Since there is an open space about the centre shaft 32, material can fall back to the beginning of the sorting unit, in case the compartments, which are defined by the angle of repose of the material, the screen cloth 37 and the flanges 34, 35, get overfull. This ensures that all the material has actually managed to be worked and had the chance to fall through the screen cloth 37 before it is conveyed to the collecting unit 40. Since the screen cloth 37 only lets through a certain amount of material per time unit (or stretch of a road at a constant speed along the road), the free space also has a levelling effect, which prevents the sorting unit 30 from being jammed and ensures that approximately the same amount of material is delivered along the stretch of the road. As already mentioned, the flanges 34, 35 in the first part of their windings or turns have a radial extension such that the free space is much more limited, which causes the material sliding back to be retained in the sorting unit 30 (see FIG. 5).

By constructing and using the sorting unit 30 in this manner, such a great amount of the gravel material which has slid down the embankment is recovered that in many cases it is not necessary to add any new material to the wearing course of the road.

The collecting unit 40 can be operated and emptied by means of a hydraulic piston 41. In many cases, the easiest way of emptying the collecting unit 40 is simply to reverse the gravel sorter so that the collecting unit 40 is outside the road and also outside a possible ditch, and then just emptying the material.

Figure 3:
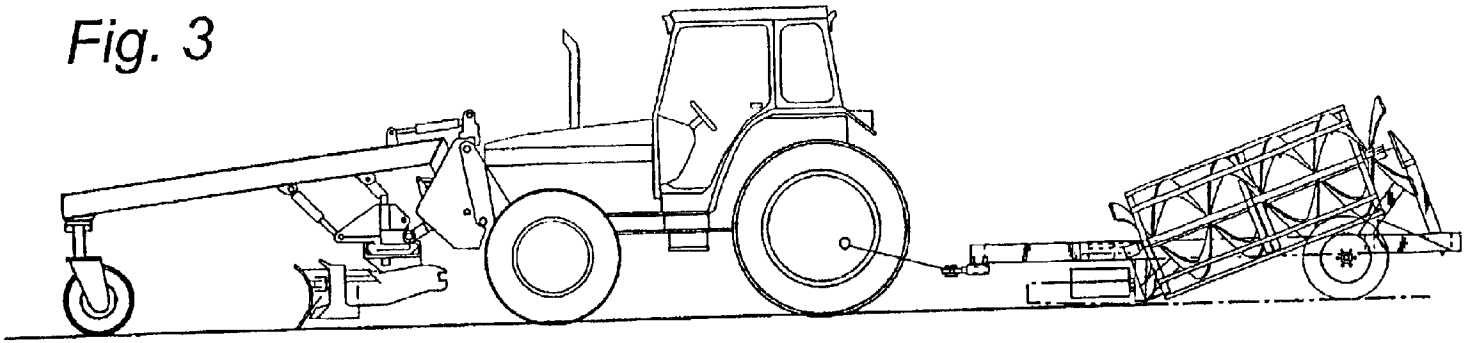
FIG. 3 shows an example of how the mobile gravel sorter can be connected to a tractor.

To make it possible to turn to such an extent that the gravel sorter can be placed at such an angle when reversing, the traction vehicle should have relatively good manoeuvrability. A suitable constellation is the use of a wheel-mounted road grader which is connected to the front of a tractor or wheel loader and a gravel sorter which is arranged to be suspended from the three-point lifting means of the tractor (see FIG. 3). This constellation is then capable of drawing up the material from the embankment by means of the grader and returning this material to the road by means of the gravel sorter. When the collecting unit 40 of the gravel sorter is to be emptied, the grader can be lifted up and thus the traction vehicle can turn relatively sharply and move the gravel sorter off the road. The collecting unit is opened and the entire gravel sorter is tipped by means of the three-point lifting means of the tractor. This constellation makes it possible for one person to maintain a road in one trip and reuse the embankment material.

It goes without saying that in cases where it is not possible or suitable from the point of view of nature protection to empty the gravel sorter directly at the roadside it can be emptied in a tractor bucket or the like.

It will be appreciated that a number of modifications of the embodiment of the gravel sorter described herein for the purpose of exemplification are possible without departing from the scope of the invention, which is defined in the appended claims.

What is claimed is:

1. A mobile gravel sorter, which is arranged to move in a direction of travel along a road, comprising a gathering unit which is arranged to gather up granular material from a roadway as the gravel sorter moves in the direction of travel, a sorting unit for sorting and supplying to the roadway the amount of the material that is smaller than a given grain size, which sorting unit comprises a substantially circular drum which is arranged after the gathering unit in the direction of travel and which has a centre axis, an inlet means in connection with the gathering unit and an outlet means which is arranged in connection with a collecting unit and separated from the inlet means in the longitudinal direction of the drum, the collecting unit for collecting material exceeding said given grain size, and a screen cloth means which is arranged to cover openings in the circumferential surface of the drum, characterised in that the sorting unit further comprises at least one screw conveyor which extends in the drum between the inlet means and the outlet means about a helical axis which is substantially concentric with the centre axis of the drum, that the screw conveyor comprises at least one radially directed flange which describes a helical line inside the drum, that the radially directed flange of the screw conveyor in the radial direction has an extension that is smaller than the inner radius of the drum and extends from the inside of the circumferential surface of the drum so that an axially directed return chamber forms about the centre axis between the inlet and outlet means of the drum, that the projection of the centre axis of the drum on the roadway is directed substantially parallel to the direction of travel of the gravel sorter, the inlet means mainly consisting of an open drum end, which is the front end in the direction of travel, and the outlet means mainly consisting of an open drum end, which is the rear end in the direction of travel, and that the centre axis of the sorting unit is inclined in relation to the horizontal plane so that its front end is lower than its rear end.

2. A gravel sorter as claimed in claim 1, in which the drum and the screw conveyor rotate together.

3. A gravel sorter as claimed in claim 2, in which the circumferential surface of the drum mainly consists of said screen cloth means.

4. A gravel sorter as claimed in claim 2, in which the sorting unit comprises a supporting, rotating shaft which is concentric with the centre axis of the drum and which supports the screw conveyor and the drum.

5. A gravel sorter as claimed in claim 2, in which the inclination of the centre axis of the sorting unit is about 20° in relation to the horizontal plane.

6. A gravel sorter as claimed in claim 1, in which the circumferential surface of the drum mainly consists of said screen cloth means.

7. A gravel sorter as claimed in claim 6, in which the sorting unit comprises a supporting, rotating shaft which is concentric with the centre axis of the drum and which supports the screw conveyor and the drum.

8. A gravel sorter as claimed in claim 6, in which the inclination of the centre axis of the sorting unit is about 20° in relation to the horizontal plane.

9. A gravel sorter as claimed in claim 1, in which the sorting unit comprises a supporting, rotating shaft which is concentric with the centre axis of the drum and which supports the screw conveyor and the drum.

10. A gravel sorter as claimed in claim 9, in which the inclination of the centre axis of the sorting unit is about 20° in relation to the horizontal plane.

11. A gravel sorter as claimed in claim 1, in which the inclination of the centre axis of the sorting unit is about 20° in relation to the horizontal plane.

* * * * *